US005655507A

United States Patent [19]

Kawasaki

[11] Patent Number: 5,655,507

[45] Date of Patent: Aug. 12, 1997

[54] EVAPORATED FUEL PURGE DEVICE FOR ENGINE

[75] Inventor: Takao Kawasaki, Yamato, Japan

[73] Assignee: Nissan Motor Co., Ltd., Kanagawa, Japan

[21] Appl. No.: 610,914

[22] Filed: Mar. 5, 1996

[30] Foreign Application Priority Data

Mar. 16, 1995 [JP] Japan ..... 7-056951

[51] Int. Cl.[6] ..... F02D 41/14; F02M 25/08

[52] U.S. Cl. ..... 123/674; 123/698

[58] Field of Search ..... 123/674, 675, 123/698, 520

[56] References Cited

U.S. PATENT DOCUMENTS

| | | | |
|---|---|---|---|
| 5,090,388 | 2/1992 | Hamburg et al. | 123/674 |
| 5,216,998 | 6/1993 | Hosoda et al. | 123/698 |
| 5,423,307 | 6/1995 | Okawa et al. | 123/698 |
| 5,501,206 | 3/1996 | Takebayashi | 123/674 |
| 5,511,526 | 4/1996 | Hamburg et al. | 123/674 |
| 5,572,980 | 11/1996 | Nakagawa et al. | 123/698 |

FOREIGN PATENT DOCUMENTS

| | | |
|---|---|---|
| 53-19729 | 6/1978 | Japan . |
| 61-87935 | 5/1986 | Japan . |

*Primary Examiner*—Willis R. Wolfe

*Attorney, Agent, or Firm*—Lowe, Price, LeBlanc & Becker

[57] ABSTRACT

Based upon a running condition of an engine, the air-fuel ratio of the fuel mixture supplied to the engine is controlled by open loop control to a target air-fuel ratio. The engine includes a mechanism which adsorbs evaporated fuel from a fuel tank, and a purge conduit which supplies a purge gas which is a mixture of this adsorbed fuel and air to the engine in a predetermined running condition. The purge flow rate is changed according to change in the target air-fuel ratio by controlling the flow rate through the purge conduit according to the proportion between the target air-fuel ratio and a predetermined value. By doing this, deviations in the air-fuel ratio precipitated by purging are eliminated, and the accuracy of air-fuel ratio control is enhanced.

11 Claims, 4 Drawing Sheets

EVAPORATED FUEL PURGE DEVICE FOR ENGINE

FIELD OF THE INVENTION

This invention relates to a purge device which supplies fuel which is evaporated in a fuel tank to an intake passage of an engine, and more particularly relates to the prevention of the air-fuel ratio error when such purging occurs.

BACKGROUND OF THE INVENTION

In Tokkai Sho 53-19729 published by the Japanese Patent Office in 1978, there is disclosed a purge mechanism in which fuel evaporated inside a fuel tank of an automobile engine is sucked into a canister, and then supplied from the canister into an intake passage of the engine.

When the pressure in the fuel tank has risen above a predetermined value, this purge mechanism feeds the evaporated fuel in the fuel tank to the canister, in which it is adsorbed by an adsorbent material like activated charcoal. Provided that specified vehicle running conditions are satisfied, the adsorbed fuel is supplied via a purge conduit to the engine intake passage as a gas mixed with air. The flow rate of this purge gas is proportioned to the flow rate of the air in the engine intake passage.

The air-fuel ratio of the fuel mixture supplied to the engine is made richer by this purging, but this can be compensated for by detecting the air-fuel ratio with a sensor and by controlling the amount of fuel injected to the engine based thereon, i.e. by so called feedback control of air-fuel ratio. However, this type of feedback control device generally is arranged to control the air-fuel ratio so as to keep t in the vicinity of the theoretical or stoichiometric value of 14.6, and when a vehicle incorporating a lean burn engine which is operated at a lean air-fuel ratio for example about 22, the air-fuel ratio is generally controlled by an open loop control method, without any feedback control. This is because oxygen sensors, which are widely used for detection of the air-fuel ratio from the oxygen concentration in the engine exhaust gas, can only detect changes of the air-fuel ratio in the vicinity of the stoichiometric value. If a sensor is used which can detect the air-fuel ratio over a relatively wide region of values thereof, it is possible to perform feedback control in the lean air-fuel ratio region as well; but the cost of this type of sensor is quite high.

In this connection, Tokkai Sho 61-87935 published by the Japanese Patent Office in 1986 discloses an air-fuel ratio control device which, during engine operation near the stoichiometric air-fuel ratio, performs feedback control for the amount of fuel injection, and which, during engine operation at a lean air-fuel ratio, performs open loop control for the amount of fuel injection by using a correction coefficient which is learned during the above described feedback control.

This device is able to control the air-fuel ratio in the lean operational region comparatively accurately without using any expensive wide range air-fuel ratio sensor.

However, even with this device, the problem remains that the air-fuel ratio enriches when engine operation at a lean air-fuel ratio and purging of evaporated fuel are performed in parallel.

As compared with operation near the stoichiometric air-fuel ratio, during operation at a lean air-fuel ratio the amount of fuel injected for the same amount of intake air is less. On the other hand, since the flow rate of the purge gas is controlled in proportion to the intake air flow rate as described above, the flow rate of the purge gas does not change if the flow rate of intake air does not change, even if the engine running conditions have changed from operation near the stoichiometric air-fuel ratio to operation at a lean air-fuel ratio. As a result, during lean engine operation, the amount of fuel supplied to the engine in the form of the purge gas is relatively increased in relation to the fuel amount of the injection. Accordingly, when the correction coefficient which was learned during engine operation near the stoichiometric air-fuel ratio is utilized for control during operation at a lean air-fuel ratio, the actual air-fuel ratio undesirably becomes richer than the target air-fuel ratio. Such enrichment of the air-fuel ratio during lean engine operation exerts an undesirable influence upon the drivability of the vehicle and upon the composition of the exhaust gases thereof.

It is possible to compensate for this tendency to enrichment by performing feedback control of lean air-fuel ratio using a wide range air-fuel ratio sensor. However, even in this case, since the amount of correction provided by such feedback control can become quite large, a certain time period is required before the air-fuel ratio reaches its target value, when switching over from operation at the stoichiometric air-fuel ratio to operation at lean air-fuel ratio.

SUMMARY OF THE INVENTION

It is therefore an object of this invention to increase the accuracy of the air-fuel ratio control in an engine which is operated at an air-fuel ratio other than the stoichiometric value while purging of evaporated fuel is taking place.

In order to achieve the above object, this invention provides a purge device for evaporated fuel from a fuel tank of an engine. The engine rotates by combustion of a mixture of air supplied via an intake passage and fuel supplied from said fuel tank via a fuel supply mechanism and comprises a mechanism for performing open loop control of an amount of fuel supplied by the fuel supply mechanism so as to make an air-fuel ratio of the mixture substantially equal to a first target value. The purge device comprises a mechanism for adsorbing fuel evaporated in the fuel tank), a purge conduit for supplying to the engine a purge gas which is a mixture of adsorbed fuel in the adsorption mechanism and air, and a mechanism for controlling a flow rate of the purge gas according to a proportion between the first target value and a predetermined value.

In an engine further comprising a mechanism for detecting the air-fuel ratio, a mechanism for performing feedback control of the amount of fuel supplied via the fuel supply mechanism so as to make the air-fuel ratio substantially equal to a second target value, and a mechanism for learning a control amount of the feedback control mechanism, it is preferable that the open loop control mechanism controls the fuel supply amount based upon a learned control amount learned by the learning mechanism and that the predetermined value is equal to said second target value.

In this case, it is further preferable that the open loop control mechanism determines the fuel supply amount by increasing or decreasing the learned control amount according to a proportion between the first target value and second target value.

It is also preferable that the learning mechanism learns an average value of the control amount of the feedback control mechanism.

It is also preferable that the learning mechanism learns separately the control amounts of the feedback control mechanism in a first condition when the purge gas is supplied to the engine and in a second condition when the purge gas is not supplied to the engine, and the open loop control mechanism, when supplying purge gas, controls the fuel supply amount based on the control amount learned in the first condition and, when not supplying purge gas, controls the fuel supply amount based on the control amount learned in the second condition.

It is also preferable that the flow rate control mechanism comprises a flow control valve provided in the purge conduit.

It is also preferable that the flow rate control mechanism comprises a mechanism for detecting an engine running condition, a mechanism for calculating a basic control amount corresponding to the engine running condition, and a mechanism for calculating a purge gas flow rate by correcting the basic control amount based upon a proportion between the first target value and a predetermined value.

In this case, it is further preferable that the engine running condition detecting mechanism comprises a mechanism for detecting an intake air flow rate in the intake passage, and the basic control amount calculating mechanism calculates the basic control amount by multiplying the air flow rate by a predetermined coefficient.

In this case, it is further preferable that the engine running condition detecting mechanism comprises a mechanism for detecting a pressure in the intake passage, and the basic control amount calculating mechanism changes the predetermined coefficient according to this pressure.

For the engine further comprising a throttle for controlling a flow rate in the intake passage, it is also preferable that the engine running condition detecting mechanism comprises a mechanism for detecting an opening amount of the throttle, and that the basic control amount calculating mechanism calculates the basic control amount by multiplying the throttle opening amount by a constant coefficient.

The details as well as other features and advantages of this invention are set forth in the remainder of the specification and are shown in the accompanying drawings.

DESCRIPTION OF THE PREFERRED EMBODIMENTS

Figure 1:
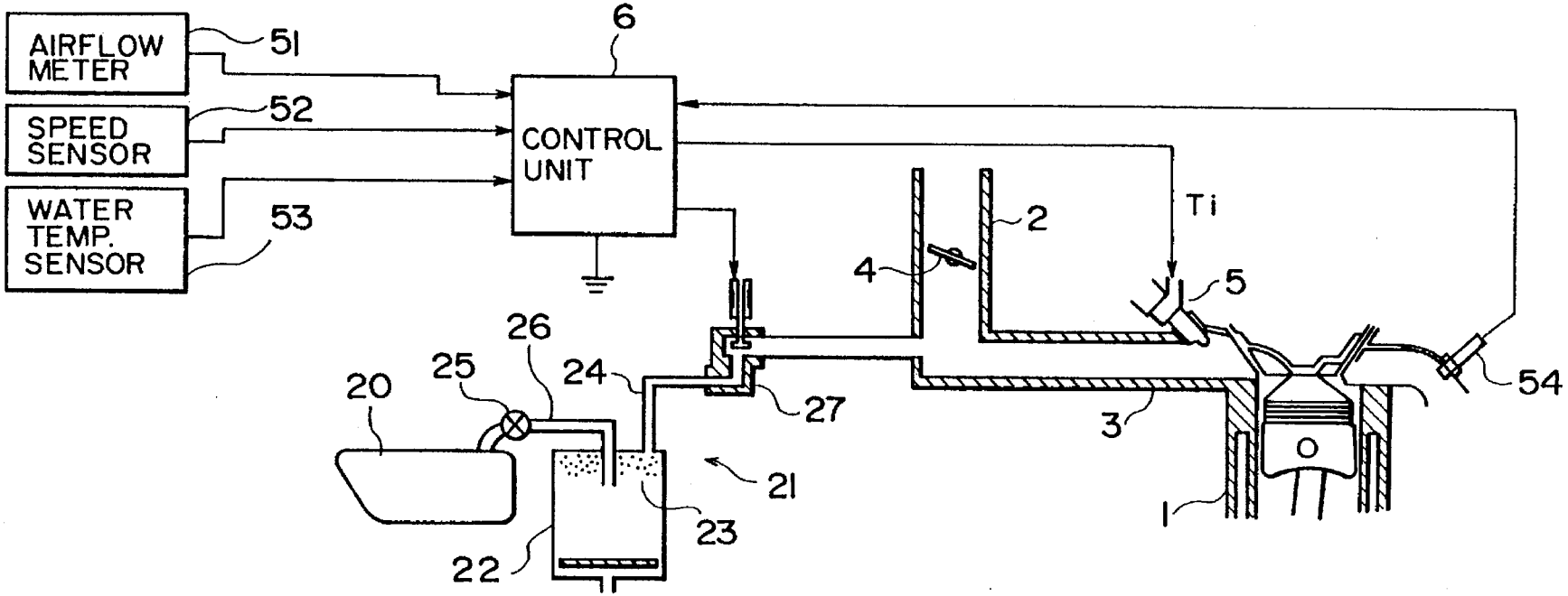
FIG. 1 is a schematic diagram of an evaporated fuel purge device according to this invention.

Referring to FIG. 1 of the drawings, a multi cylinder water cooled engine 1 for an automobile sucks in air from an intake passage 2 via an intake manifold 3. A throttle 4 which is linked to an accelerator pedal not shown in the drawings so as to be driven thereby is provided within the intake passage 2 so as to control the flow rate of air Q in the intake passage 2. In the intake manifold 3 there is provided a fuel injection valve 5 for each cylinder of the engine, in order to inject fuel thereinto. Fuel is supplied under pressure from a fuel tank 20 via a fuel pump not shown in the figures, and is injected into the intake manifold 3 by the fuel injection valve 5. The amount of fuel which is injected by the fuel injection valve 5 is controlled by a control unit 6 which comprises a microcomputer.

The engine 1 comprises an evaporated fuel purge device 21 which supplies fuel evaporated within the fuel tank 20 to the intake passage 2. This evaporated fuel purge device 21 comprises a canister 22 which holds a quantity of adsorbent 23 which adsorbs the fuel evaporated within the fuel tank 20 via an evaporated fuel conduit 26, and a purge conduit 24 which supplies fuel which has been adsorbed by the adsorbent 23 to the intake passage 2 at the downstream side of the throttle 4. The conduit 26 comprises a check valve 25 which opens when the pressure within the fuel tank 20 rises above a predetermined value. The fuel evaporated within the fuel tank 20 enters into the canister 22 via this check valve 25. An electromagnetically driven flow control valve 27 is provided within the purge conduit 24. The opening of this flow control valve 27 is controlled according to the duty factor of a control signal which is output by the aforesaid control unit 6.

The engine 1 comprises an air flow meter 51 which detects the air flow rate Q in the intake passage 2 at the upstream side of the throttle 4, a rotational speed sensor 52 which detects the number of rotations per second N of the engine 1, a cooling water temperature sensor 53 which detects the temperature Tw of the cooling water of the engine 1, and an oxygen sensor 54 which detects the air-fuel ratio of the fuel mixture being supplied to the engine 1 from the amount of oxygen concentration in the engine exhaust gas. All the signals output from these sensors are input to the control unit 6.

According to engine running conditions, based upon the output signals from these sensors, the control unit 6 controls the air-fuel ratio of the fuel mixture to the stoichiometric air-fuel ratio, or to other air-fuel ratios including lean air-fuel ratio, by controlling the amount of fuel injected by the fuel injection valve 5 and the opening amount of the flow control valve 27 in the purge conduit 24.

Figure 2:
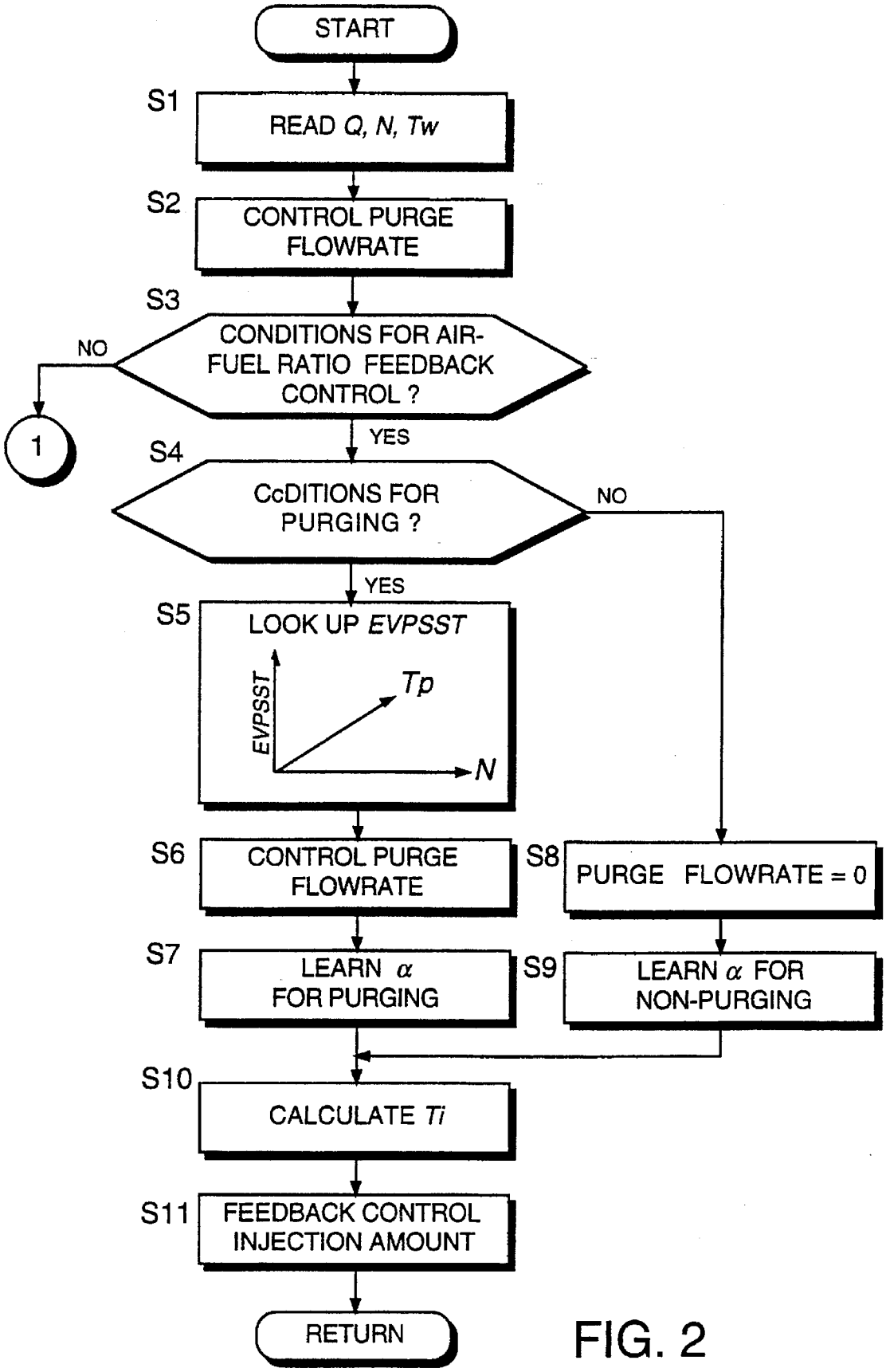
FIG. 2 is a flow chart showing a process of feedback control of air-fuel ratio, according to this invention.
Figure 3:
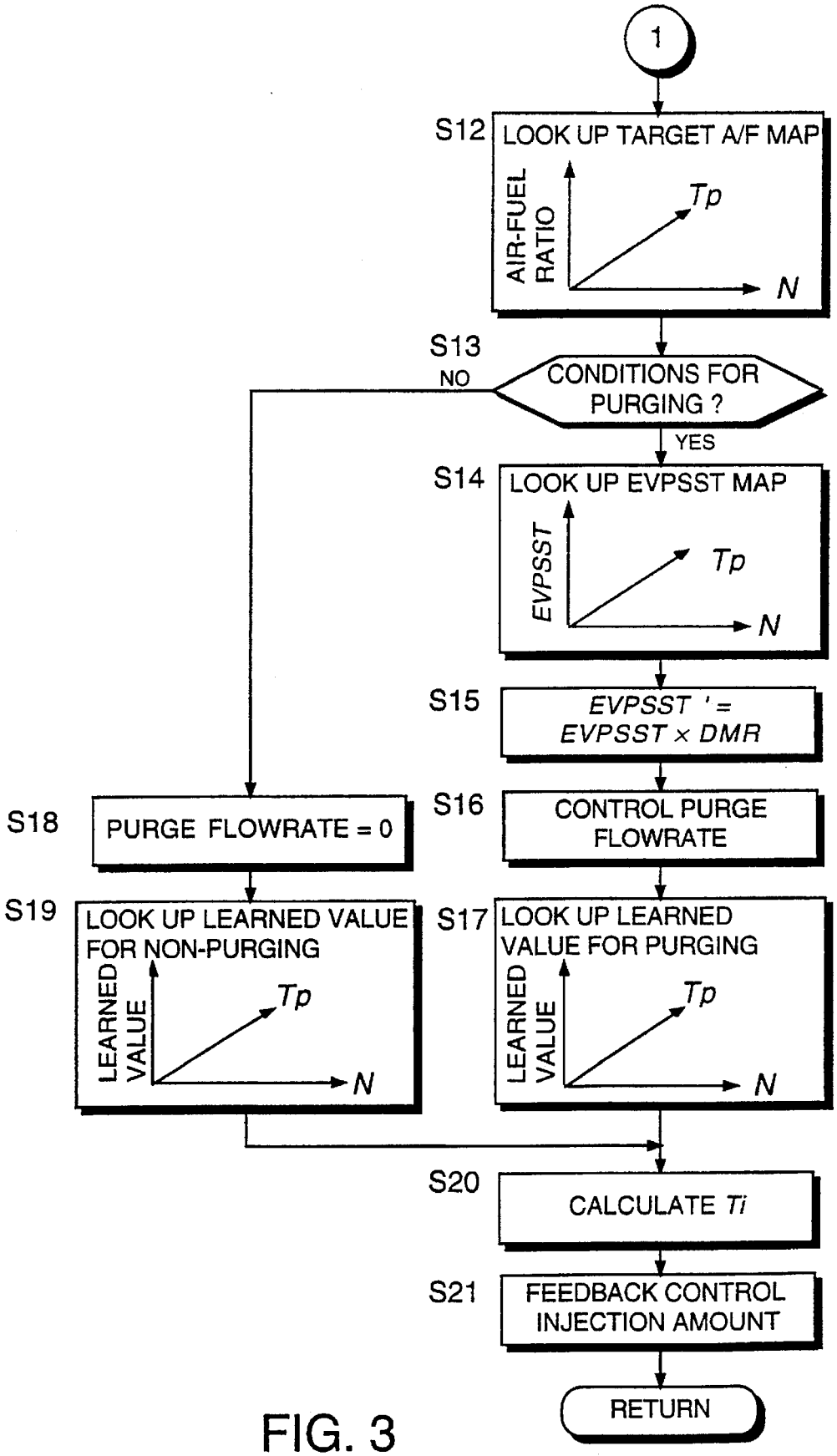
FIG. 3 is a flow chart showing a process of open loop control of air-fuel ratio, according to this invention.

The control of the air-fuel ratio to the stoichiometric ratio is performed by a feedback control process which is shown in FIG. 2. And the control of the air-fuel ratio to other target ratios is performed by an open loop control process which is shown in FIG. 3.

Thus, in a first step S1 of FIG. 2, the air flow rate Q detected by the flow meter 51, the rotational speed N of the engine detected by the rotational speed sensor 52, and the temperature Tw of the cooling water of the engine 1 detected by the cooling water temperature sensor 53 are read in.

In a step S2, based upon the air flow rate Q and the engine rotational speed N, a basic fuel injection amount Tp is calculated according to the following equation:

$$Tp = \frac{k \cdot Q}{N}$$

where, k is a constant.

In a step S3, a decision is made as to whether or not the conditions for performing feedback control to the stoichiometric air-fuel ratio hold, based upon the running conditions of the engine as detected by the various sensors.

If these conditions hold, the process proceeds to a step S4, in which a decision is made as to whether or not the current engine running conditions are suitable for performing purging of the fuel which has been accumulated and stored in the canister 22 due to evaporation within the fuel tank 20.

If the conditions for purging hold, the process proceeds to a step S5, and a basic opening control amount EVPSST for the flow control valve 27 is looked up from a map which specifies EVPSST according to the engine rotational speed N and the basic fuel injection amount Tp. From the above equation, the air flow rate Q is determined by the engine rotational speed N and the basic fuel injection amount Tp. This map is one which specifies the basic opening control amount EVPSST so as to bring the purge ratio, i.e. the ratio between the purge gas flow rate and the air flow rate Q, to a ratio, which may for example be 1%.

In a step S6, the purge flow rate through the flow control valve 27 is controlled by duty factor control according to the basic opening control amount EVPSST which was determined upon above.

In a step S7, an air-fuel ratio feedback correction coefficient is learnt on the basis of the above described purging. This air-fuel ratio feedback correction coefficient is a coefficient by which the previously described basic fuel injection amount Tp is multiplied, based upon the air-fuel ratio detected by the oxygen sensor 54, and is increased or decreased according as to whether the air-fuel ratio detected by the oxygen sensor 54 is leaner or richer than the stoichiometric air fuel ratio. The learning is performed by averaging the air-fuel ratio feedback correction coefficient over a predetermined sampling time interval, and by storing the result.

In concrete terms, the correction coefficient when the detected air-fuel ratio changes from lean to rich or from rich to lean is sampled several times, and the average of these sampled values is stored as the learned value. Or the value which is obtained by adding a certain portion of the deviation between a standard value (for example 1) for the air-fuel ratio correction coefficient and the average value of the values which were obtained by sampling to an initial value (for example 1) can be stored as the learned value. These learned values are stored as learned values with purging for each engine running region, as classified by the engine rotational speed N and by the load upon the engine which is represented by the basic fuel injection amount Tp.

If in the step S4 it is decided that the conditions for performing purging do not currently hold, then the process proceeds to a step S8. In the step S8, the opening amount duty factor for the flow control valve 27 is set to zero, so that the flow control valve 27 is closed and purging is prevented. Subsequently in a step S9 the process is executed of learning an air-fuel ratio feedback correction coefficient for this state in which purging is not being performed. The procedure for learning this coefficient is the same as in the above described step S7, but the learnt values are stored as the learnt values without purging.

Using the coefficient $\alpha_L$ which was learnt in the step S7 or in the step S9 as described above, an amount of fuel Ti to be injected by the fuel injection valve 5 is calculated in a step S10 using the following equation:

$$Ti=Tp\cdot COEF\cdot\alpha_L\cdot\alpha+Ts$$

where, COEF represents various correction coefficients which are set in dependence upon the temperature Tw of the engine cooling water etc., and $\alpha$ is an air-fuel ratio feedback correction coefficient which is increased or decreased according to the output signal from the oxygen sensor 54. Ts is an ineffective fuel injection portion which corresponds to the response delay of the fuel injection valve, and changes according to the voltage of the battery which is operating the fuel injection valve.

Ti is calculated as a pulse width. In a final step S11, feedback control of the air-fuel ratio is performed by outputting a pulse signal having this pulse width to the fuel injection valve 5.

If in the step S3 it is decided that the conditions for performing air-fuel ratio feedback control do not hold, then the flow of control is transferred to a step S12 of the FIG. 3 and the subsequent steps in which the air-fuel ratio is controlled by open loop control.

In this step S12, a target air-fuel ratio is looked up in a map based upon the engine rotational speed N and the basic fuel injection amount Tp, and is stored as the target air-fuel ratio.

Next in a step S13 a decision is made as to whether or not the conditions for purging hold, just as in the previously described step S4.

If the conditions for purging hold, in a step S14 a basic opening control amount EVPSST for the flow rate control valve 27 is looked up, just as in the previously described step S5.

In a step S15, correction is performed for this basic opening control amount EVPSST according to the following equation:

$$EVPPST=EVPPST\cdot DMR$$

where, DMR is a ratio of fuel-air ratios as determined by the following equation:

$$DMR=\frac{\text{target fuel}-\text{air ratio}}{\text{base fuel}-\text{air ratio}}$$

The base fuel/air ratio is the reciprocal of the air-fuel ratio just before the switchover to the present target air-fuel ratio, in other words, in this embodiment, of the stoichiometric air-fuel ratio. The target fuel/air ratio is the reciprocal of the current target air-fuel ratio.

Accordingly, by compensating the basic opening control amount EVPSST by this target proportional fuel/air ratio DMR, if the target air-fuel ratio is a lean air-fuel ratio, the flow rate of purge gas is reduced by correction in correspondence with this as well.

In a step S16, the opening amount of the flow control valve 27 is controlled by duty factor control according to the opening control amount EVPPST'.

In a step S17, a learned value for the air-fuel ratio correction coefficient during purge conditions is looked up from a map, based upon the engine rotational speed N and upon the basic fuel injection amount Tp. This map is the one which was constructed by learning during previous iterations of the step S7.

If in the step S13 it is decided that the conditions for performing purging do not currently hold, then the process proceeds to a step S18. In the step S18, the opening amount duty factor for the flow control valve 27 is set to zero, so that the flow rate control valve 27 is closed and purging is prevented. Subsequently in a step S19 a learned value for the air-fuel ratio correction coefficient for this state in which purging is not being performed is looked up from a map. This map is the one which was constructed by learning during previous iterations of the step S9.

After looking up the learned coefficient $\alpha_L$ in this manner, an amount of fuel Ti to be injected is calculated in a step S20 using the following equation:

$$Ti=Tp\cdot COEF\cdot DMR\cdot\alpha_L\cdot\alpha+Ts$$

In the final step S11, open loop control of the air-fuel ratio is performed by outputting to the fuel injection valve 5 a pulse signal having a pulse width corresponding to the calculated amount of fuel Ti.

In this manner, by calculating the amount of fuel to be injected using the ratio DMR and the learned coefficient $\alpha_L$, not only can a fuel injection amount corresponding to the air-fuel ratio be obtained, but also there is no undesirable enrichment of the air-fuel ratio by the purge gas, even if switching over from the stoichiometric air-fuel ratio to a lean air-fuel ratio has been performed, since the flow rate of the purge gas is also corrected by this ratio DMR, and the air-fuel ratio of the total quantity of fuel mixture including the purge gas is kept in the vicinity of the target air-fuel ratio.

The aforesaid control of the flow rate of purge gas according to this invention is effective even for the engines in which learning of the air-fuel ratio feedback correction coefficient is not performed, but only the air-fuel ratio feedback control to the stoichiometric air-fuel ratio is performed.

When learning is performed, the accuracy of the learned values is enhanced by performing learning separately both during purging and non-purging, as with the above described embodiment, but control of the flow rate of purge gas according to this invention is effective, even when learning is performed without distinguishing between purging and non-purging.

Figure 4:
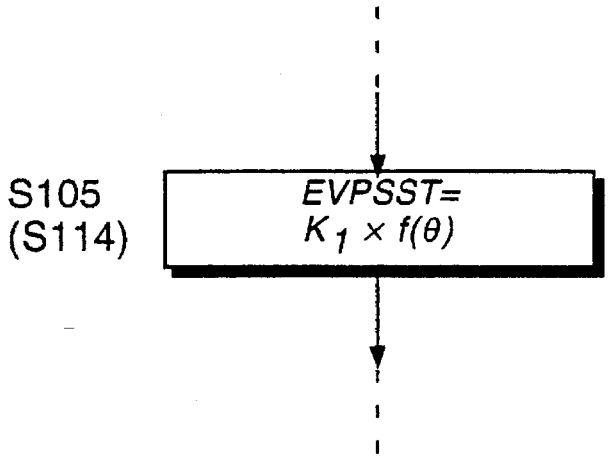
FIG. 4 is a flow chart showing a characteristic portion of a process of open loop control of air-fuel ratio, according to a second embodiment of this invention.

FIG. 4 shows a second preferred embodiment of this invention.

A single step shown here is to be substituted for the step S5 in the FIG. 2 as a new step S105, and for the step S14 in the FIG. 3 as a new step S114. According to this second embodiment, the engine 1 comprises a throttle opening sensor which detects the opening degree θ of the throttle 4. In the steps S105 and S114, the basic opening control amount EVPSST is determined as a proportion of the throttle opening area f(θ) which is obtained from the opening degree θ the throttle 4. In the equation in FIG. 5, $k_1$ is a constant.

The possibility of this sort of setting is available because the purge ratio, which is the ratio between the flow rate of the purge gas and the flow rate Q of the intake air, approximates to the ratio between the opening area of the flow control valve 27 and that of the throttle 4. According to this second embodiment, it becomes possible to determine the basic opening control amount EVPSST only from the throttle opening degree θ, and not in dependence upon the two detected values of the engine rotational speed N and the air flow rate Q.

Figure 5:
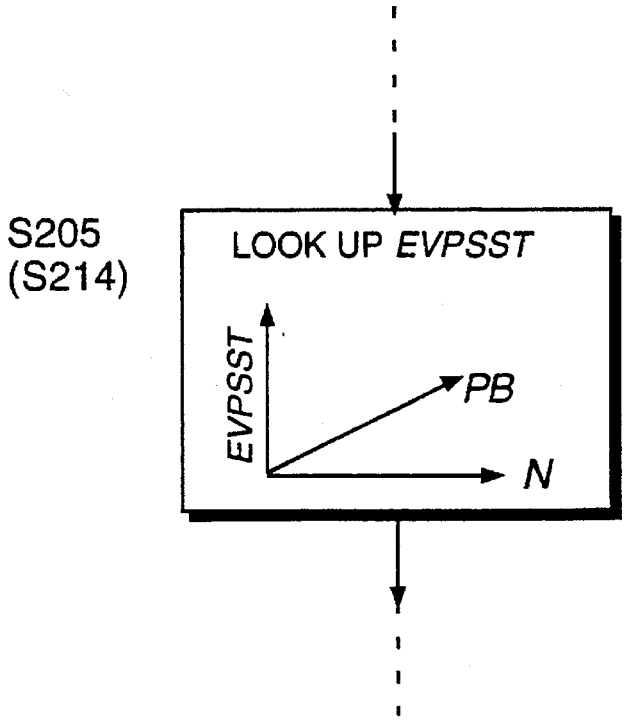
FIG. 5 is a flow chart showing a characteristic portion of a process of open loop control of air-fuel ratio, according to a third embodiment of this invention.

FIG. 5 shows a third embodiment of this invention.

The single step shown here is to be substituted for the step S5 n FIG. 2 as a new step S205, and for the step S14 in FIG. 3 as a new step S214. According to this third embodiment, the engine 1 comprises a pressure sensor which detects negative pressure PB of the intake passage 2 at the confluence of the purge conduit 24 on the downstream side of the throttle 4. A map of the basic opening control amount EVPSST is constructed according to the air flow rate Q and the intake pressure PB, and in the steps S205 and S214 EVPSST is looked up from this map.

As described above, the basic opening control amount EVPSST for the flow rate control valve 27 can be set using various parameters representing the engine running conditions.

Accordingly, although the present invention has been shown and described in terms of the preferred embodiments thereof, it is not to be considered as limited by any of the perhaps quite fortuitous details of said embodiment, or of the drawings, but only by the terms of the appended claims, which follow.

I claim:

1. A purge device for evaporated fuel from a fuel tank of an engine which rotates by combustion of a mixture of air supplied via an intake passage and fuel supplied from said fuel tank via a fuel supply means, and which comprises means for performing open loop control of an amount of fuel supplied by said fuel supply means so as to make an air-fuel ratio of said mixture substantially equal to a first target value, said purge device comprising:

means for adsorbing fuel evaporated in said fuel tank, a purge conduit for supplying to said engine a purge gas which is a mixture of adsorbed fuel in said adsorption means and air, and means for controlling a flow rate of said purge gas according to a proportion between said first target value and a predetermined value.

2. A purge device for evaporated fuel according to claim 1, wherein said engine further comprises means for detecting said air-fuel ratio, means for performing feedback control of the amount of fuel supplied via said fuel supply means so as to make said air-fuel ratio substantially equal to a second target value, and means for learning a control amount of said feedback control means, and wherein said open loop control means controls the fuel supply mount based upon a learned control amount learned by said learning means and said predetermined value is equal to said second target value.

3. A purge device for evaporated fuel according to claim 2, wherein said open loop control means determines the fuel supply amount by increasing or decreasing said learned control amount according to a proportion between said first target value and said second target value.

4. A purge device for evaporated fuel according to claim 2, wherein said learning means learns an average value of the control amount of said feedback control means.

5. A purge device for evaporated fuel according to claim 2, wherein said learning means learns separately the control amounts of said feedback control means in a first condition when said purge gas is supplied to said engine and in a second condition when said purge gas is not supplied to said engine, and said open loop control means, when supplying purge gas, controls the fuel supply amount based on the control amount learned in the first condition and, when not supplying purge gas, controls the fuel supply amount based on the control amount learned in the second condition.

6. A purge device for evaporated fuel according to claim 2, wherein said second target value corresponds to a stoichiometric air-fuel ratio while said first target value corresponds to an air-fuel ratio leaner than said stoichiometric air-fuel ratio.

7. A purge device for evaporated fuel according to claim 1, wherein said flow rate control means comprises a flow control valve provided in said purge conduit.

8. A purge device for evaporated fuel according to claim 7, wherein said engine further comprises a throttle for controlling a flow rate in said intake passage, and wherein said engine running condition detecting means comprises means for detecting an opening amount of said throttle, and said basic control amount calculating means calculates said basic control amount based on said throttle opening amount.

9. A purge device for evaporated fuel according to claim 1, wherein said flow rate control means comprises means for detecting an engine running condition, means for calculating a basic control amount corresponding to said engine running condition, and means for calculating a purge gas flow rate by correcting said basic control amount based upon a proportion between said first target value and a predetermined value, and wherein said flow rate control means controls said flow rate of said purge gas so as to be equal to said calculated purge gas flow rate.

10. A purge device for evaporated fuel according to claim 9, wherein said engine running condition detecting means comprises means for detecting an intake air flow rate in said intake passage, and said basic control amount calculating means calculates said basic control amount based on said air flow rate.

11. A purge device for evaporated fuel according to claim 9, wherein said engine running condition detecting means comprises means for detecting an intake air flow rate in said intake passage and means for detecting a pressure in said intake passage, and said basic control amount calculating means calculates said basic control amount based on said air flow rate and said pressure.

* * * * *